US010502019B2

(12) United States Patent
Sahi

(10) Patent No.: US 10,502,019 B2
(45) Date of Patent: Dec. 10, 2019

(54) TIE BACK FLOAT COLLAR

(71) Applicant: Riaz Ahmed Sahi, Toronto (CA)

(72) Inventor: Riaz Ahmed Sahi, Toronto (CA)

( * ) Notice: Subject to any disclaimer, the term of this patent is extended or adjusted under 35 U.S.C. 154(b) by 53 days.

(21) Appl. No.: 15/226,089

(22) Filed: Aug. 2, 2016

(65) Prior Publication Data

US 2018/0038196 A1 Feb. 8, 2018

(51) Int. Cl.

| | |
|---|---|
| ***E21B 17/08*** | (2006.01) |
| ***E21B 33/14*** | (2006.01) |
| ***E21B 34/06*** | (2006.01) |
| ***E21B 17/02*** | (2006.01) |
| ***E21B 21/10*** | (2006.01) |

(52) U.S. Cl.
CPC ..... *E21B 33/14* (2013.01); *E21B 17/021* (2013.01); *E21B 21/10* (2013.01)

(58) Field of Classification Search
CPC ..... E21B 17/02; E21B 17/08; E21B 33/13; E21B 33/14; E21B 43/10; E21B 43/106; E21B 34/06
See application file for complete search history.

(56) References Cited

U.S. PATENT DOCUMENTS

| | | | | |
|---|---|---|---|---|
| 3,409,078 A * | 11/1968 | Knox | ..... | E21B 21/10 166/285 |
| 3,601,208 A * | 8/1971 | Greer | ..... | E21B 43/10 166/205 |
| 5,277,255 A * | 1/1994 | Bell | ..... | E21B 17/06 166/290 |
| 2013/0075094 A1* | 3/2013 | Rankin | ..... | E21B 33/14 166/281 |

* cited by examiner

*Primary Examiner* — Kenneth L Thompson
(74) *Attorney, Agent, or Firm* — Elias Borges

(57) ABSTRACT

There is disclosed a tie back float collar for use with a working string to create an extension of a well liner. The tie back float collar consists of a cylindrical housing having upper and lower cylindrical plugs threaded therein, the upper cylindrical plug having a conical left hand threaded receiver coaxially formed thereon with opposite upper and lower openings, the upper opening being larger than the lower opening. The lower cylindrical plug has a conical opening coaxially formed therein with a conical plug coaxially positioned within the conical opening. A biasing spring is coupled to the conical plug and the lower cylindrical plug for biasing the conical plug towards a closed position, the biasing spring positioned above the conical plug.

3 Claims, 2 Drawing Sheets

TIE BACK FLOAT COLLAR

FIELD OF THE INVENTION

The invention relates generally to tie back float collar's used in the drilling of deep wells.

BACKGROUND OF THE INVENTION

Extending an existing wall involves drilling through a well lining and then lowering a well lining extension into the drilled bore. Cement can then be poured into the space between the walls of the bore and the well lining extension to form a permanent concrete/cement well lining. A variety of methods exist for filling the space between the walls of the bore and the well lining extension. One method as disclosed in U.S. Pat. No. 5,277,244 to Bell involves attaching a well liner running shoe to the bottom of the well liner extension and then using the working string to pump cement down the well liner. A one way valve is formed in the running shoe in the Bell patent to prevent the backflow of cement into the well lining. While the running shoe disclosed in Bell is suitable, it is fairly complex to build and operate. An improved valve/tie back float collar which overcomes the disadvantages of the Bell device is therefore required.

SUMMARY OF THE INVENTION

In accordance with one aspect of the present invention, there is provided a tie back float collar for use with a working string to create an extension of a well liner. The tie back float collar consists of a cylindrical housing having opposite upper and lower ends, an upper series of threads formed on an outside surface of the cylindrical housing adjacent the upper end of the cylindrical housing, the upper series of threads configured for attachment to the well liner. A lower series of threads is formed on the outside surface of the cylindrical housing adjacent the lower end. An upper cylindrical plug is threaded within the upper end of the cylindrical housing, the upper cylindrical plug having a conical left hand threaded receiver coaxially formed thereon with opposite upper and lower openings, the upper opening being larger than the lower opening. A lower cylindrical plug is threaded within the cylindrical housing towards the lower end, the lower cylindrical plug having a conical opening coaxially formed therein with a smaller sized upper opening and larger sized lower opening. A conical plug is coaxially positioned within the conical opening of the lower plug, the conical plug movable between a closed position wherein the conical plug is fully contained within the conical opening, and an open position wherein the conical plug is positioned away from the conical opening. A biasing spring is coupled to the conical plug and the lower cylindrical plug for biasing the conical plug towards its closed position, the biasing spring positioned above the conical plug and adjacent the upper opening of the lower cylindrical plug.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention.

DESCRIPTION OF THE DRAWINGS

In the drawings like characters of reference indicate corresponding parts in the different figures.

DETAILED DESCRIPTION OF THE INVENTION

Figure 2:
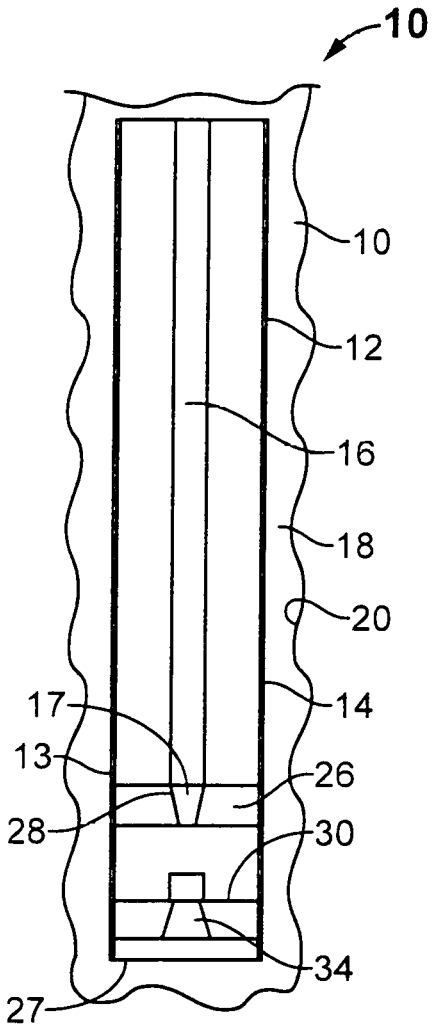
FIG. 2 is a sectional view of the tie back float collar of FIG. 1 being used in extending a well lining.

Referring to FIG. 2, the present invention is used to extend an existing well having a well lining. The process of extending a well involved drilling through the existing well lining to a form a bore 10 into which a well lining extension 12 is inserted. Well lining extension 12 has a lower end 13 and the tie back float collar 14 made in accordance with the present invention is coupled there to. A working string 16 is coupled to float collar 14. Cement is pumped through working string 16 which passes through float collar 14, out bottom end 17 and then into space 18 of bore 10 to fill the space between lining extension 12 and inside wall 20 or bore 10. In this way a new lined well extension is formed. Float collar 14 ensures that the cement is directed into space 18 and not into the interior of lining extension 12. Float collar 14 can be left in place after the cement has cured.

Figure 1:
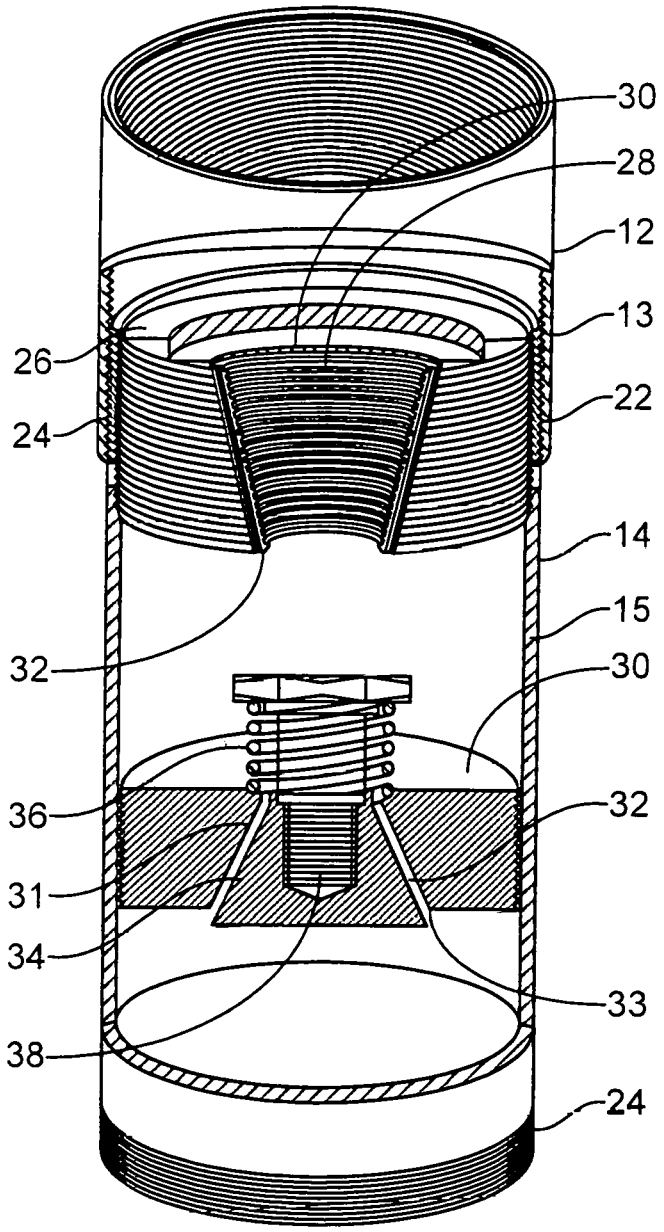
FIG. 1 is a sectional view of a tie back float collar made in accordance with the present invention.

Referring now to FIG. 1, float collar 14 consists of a cylindrical housing 15 having upper end 22 and lower end 24. Upper end 22 is threaded on the outside surface 24 thereof so it can be threaded into lower end 13 of lining extension 12. Upper cylindrical plug 26 is threaded into upper end 22 and is coaxially aligned with the cylindrical housing. Conical threaded aperture 28 is formed on upper cylindrical plug 26 and is coaxially aligned with the upper cylindrical plug and with cylindrical housing 15. Conical aperture 28 has upper opening 30 which is of larger diameter than lower opening 32. Preferably conical aperture 28 has left handed threads to permit it to fit to end 17 of working string 16 (see FIG. 1).

Lower cylindrical plug 30 is threaded into cylindrical housing 15 towards bottom end 24. Lower cylindrical plug 30 is coaxially aligned with cylindrical housing 15. Conical aperture 32 is formed in the center of lower cylindrical plug 30 and has upper opening 31 and lower opening 33. Upper opening 31 has a smaller diameter than lower opening 33. Conical plug 34 closely conforms in shape to conical aperture 32 so that when the conical plug is fully inserted into the conical aperture, the conical aperture is plugged closed. Conical plug 34 is positioned within conical opening 32 and is movable between a closed position wherein the conical plug is all the way into the conical opening and an open position wherein the conical plug is partially outside of the conical opening, as illustrated in FIG. 1. Conical plug 34 is biased towards its closed position by compression coil spring 36 which is positioned above conical opening 32. Coils spring 36 is a standard coil compression spring which is coaxially mounted to lower cylindrical plug 30 immediately adjacent upper opening 31. Connector rod 38 is mounted at one end to conical plug 34. The opposite end of connector rod 38 is mounted to an end of coil spring 36 so that the coil spring biases the conical plug upwardly into its closed position. The upper and lower cylindrical plugs and the conical plug are preferably made of a drillable material such as plastic or aluminum.

Referring back to FIG. 2, in operation, float collar 14 is screwed into end 13 of lining extension 12 and working string 16 is coupled at end 17 into the float collar. Cement can then be pumped down working string 16 and out end 27 of the float collar. The cement makes its way into space 18 between the walls 20 of bore 10 and lining extension 12.

Conical plug 34 prevents cement from flowing back into working string 16 after the cement has been pumped through the working string. After the cement has been pumped, working string 16 can be detached from upper cylindrical block 26 of float collar 14 simply by rotating the working string in a left wise orientation due to the fact that threaded conical opening 28 is provided with left handed threads. This permits easy detachment of the working string from the float collar. Since the principle components of working collar 14 are made of either plastic or aluminum, the working collar can be easily drilled through in the event that the well needs to be extended even deeper.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims Therefore, what is claimed is:

1. A tie back float collar for use with a working string to create an extension of a well liner, the tie back float collar comprising:

a cylindrical housing having opposite upper and lower ends, an upper series of threads formed on an outside surface of the cylindrical housing adjacent the upper end of the cylindrical housing, the upper series of threads configured for attachment to the well liner;

a lower series of threads formed on the outside surface of the cylindrical housing adjacent the lower end;

an upper cylindrical plug threaded within the upper end of the cylindrical housing, the upper cylindrical plug having a conical left hand threaded receiver coaxially formed thereon with opposite upper and lower openings, the upper opening being larger than the lower opening;

a lower cylindrical plug threaded within the cylindrical housing towards the lower end, the lower cylindrical plug having a conical opening coaxially formed therein with a smaller sized upper opening and larger sized lower opening;

a conical plug coaxially positioned within the conical opening of the lower plug, the conical plug movable between a closed position wherein the conical plug is fully contained within the conical opening, and an open position wherein the conical plug is positioned away from the conical opening;

a biasing spring coupled to the conical plug and the lower cylindrical plug for biasing the conical plug towards its closed position, the biasing spring positioned above the conical plug and adjacent the upper opening of the lower cylindrical plug.

2. The tie back float collar as defined in claim 1 wherein the biasing spring is a compression spring coaxially mounted to the lower cylindrical plug at the upper opening, a connector rod coupled to an upper end of the compression spring, the connector rod passing through the compression spring to couple to the conical plug.

3. The tie back float collar as defined in claim 2 wherein the upper and lower plug and the conical plug are made of a drillable material selected from the group of materials comprising aluminum and plastic.

* * * * *